United States Patent [19]

Marrache et al.

[11] Patent Number: 4,876,973

[45] Date of Patent: Oct. 31, 1989

[54] METHOD OF AND APPARATUS FOR BLIND TUFTING COMPOSITE LAMINATED JOINTS

[75] Inventors: Albert A. Marrache, Smyrna; Frank C. Snipes, Jr., Marietta, both of Ga.

[73] Assignee: Lockheed Corporation, Calabasas, Calif.

[21] Appl. No.: 647,062

[22] Filed: Sep. 4, 1984

[51] Int. Cl.[4] ..... D05B 21/00

[52] U.S. Cl. ..... 112/121.16; 112/121.12

[58] Field of Search ..... 112/410, 411, 2.2, 121.16, 112/121.12, 121.14; 156/93, 293; 428/61, 102, 113, 174, 295, 902

[56] References Cited

U.S. PATENT DOCUMENTS

| | | | |
|---|---|---|---|
| 4,059,468 | 11/1977 | Bouillon | 156/93 |
| 4,206,895 | 6/1980 | Olez | 156/93 |
| 4,256,790 | 3/1981 | Lackman | 156/93 |
| 4,331,495 | 5/1982 | Lackman | 156/93 |
| 4,331,723 | 5/1982 | Hamm | 156/93 |
| 4,344,471 | 8/1982 | Ibuki | 156/93 |
| 4,503,788 | 3/1985 | Giannuzzi et al. | 112/121.12 |

*Primary Examiner*—Donald P. Walsh

*Attorney, Agent, or Firm*—Robert P. Barton; Vangelis Economou; Stanley L. Tate

[57] ABSTRACT

A self-threading stitching device for joining uncured composite laminates which comprises a vertically mounted needle shaft adapted for reciprocal motion, a thread feeding means operating synchronously with the needle shaft and self-threading needle means adapted to pick up the thread from the thread feeding means and carry the thread through uncured composite laminate being penetrated by the needle and release the thread in the laminate as the needle withdraws therefrom.

19 Claims, 6 Drawing Sheets

METHOD OF AND APPARATUS FOR BLIND TUFTING COMPOSITE LAMINATED JOINTS

TECHNICAL FIELD

This invention generally relates to reinforced composite structures. More particularly, this invention relates to a method and apparatus for stronger joining of detail parts in order to realize the potential of large composite assemblies for lighter weight, superior thermal properties, increased strength and improved modules of elasticity by producing a loop stitch with no apparatus on the exit side of the joint.

BACKGROUND ART

Designs for aerospace vehicles that fly now and that will fly in the next several decades emphasize increased maneurverability, energy conservation, safety of personnel and increased ability to achieve and maintain both tactical and strategic superiority in a given theater of operations. Because of the increased performance demands being placed on aerospace vehicles many of the production materials once considered standards have been found to be inadequate; therefore, there has been an increasing emphasis on the development of composite materials because of their high strength to weight ratio. Strong, light-weight sheet materials have been developed which comprise generally a resinous sheet reinforced with layers of continuous, parallel filaments. These sheets may be formed as a single layer sheet or as multi-layer laminates and are cured to form tough, hard, exceptionally strong panels for skins.

Since the earliest days of the aircraft industry, those skilled in the art of airplane construction have searched for fasteners that could accommodate shear and tensile loading between the skin of the aircraft and the load carrying substructure. Until very recently, mechanical fasteners were used to the exclusion of all other types of fasteners to attach the skin to the substructure of an airplane. The use of mechanical fasteners in composite structures increases the cost of final assembly because of special drilling and reinforcement requirements and because fasteners used in composite applications must be made from more expensive materials to prevent serious corrosion from occurring on the finished aircraft.

The prior art as evidenced by U.S. Pat. Nos. 1,504,817; 1,519,772; 1,901,864; 2,053,048; 2,161,802 and 2,483,916 teaches stitching as a method for fastening a skin to a substructure. In these patents the artisan is taught to attach the skin to an intermediate tape that is attached to the substructure. More recent prior art, U.S. Pat. Nos. 4,206,895; 4,256,790 and 4,331,723 teach stitching as a method to join composite subparts to form a larger part. Although stitching composite joints has produced significant increases in composite joint strength, until now the process has been limited in application because all prior art composite stitching processes generally require access to both sides of the parts being joined. This requirement is a serious constraint on the size and shape of parts which may be stitched because previous methods and apparatus have required access to both sides of the part.

DISCLOSURE OF THE INVENTION

Accordingly, it is an object of the present invention to provide an apparatus for blind stitching joints of composite laminates.

Another object of the present invention is to provide a self-threading stitching device capable of motion in three planes along the surface of uncured graphite epoxy composite laminates.

Yet another object of the present invention is to provide a self-threading stitching device adapted for quick needle changes and further adapted to receive and hold a needle in only one position, thereby eliminating the possibility of misaligning the needle with respect to the thread.

Yet another object of the present invention is to provide stitching apparatus for use with graphite epoxy laminates, the operation of which does not require preheating the laminate.

Still a further object of the present invention is to provide a stitching device capable of penetrating a graphite epoxy laminate and forming stitched joints therein while minimizing the resulting physical damage to the laminate matrix and the reinforcement therein.

Another object of the present invention is to provide a method of forming stitched joints in graphite epoxy laminates which minimizes physical damage to the laminate matrix and the reinforcement therein.

A principal feature of the present invention is the provision of a unique approach to stitch formation in composite laminate joining, such joining now being accomplished in the art by apparatus requiring access to both sides of the laminates being joined. In accordance with the present invention, a method and apparatus are provided for joining composite laminate detail pieces by using a blind stitching technique. The apparatus comprises a self-threading needle mounted on a vertically reciprocating needle shaft, a thread feeding and positioning means for maintaining the tension of the thread and for positioning the thread in proper relationship with the reciprocating needle so that on each downward stroke of the needle, thread is picked up by the needle and carried through the laminate to form a loop of constant size as the needle is extracted from the laminate on the upward stroke of the reciprocating shaft. The apparatus uses the excess thread in combination with thread withdrawn from a spool or other thread supply to form a series of loop stitches of constant dimensions.

Another feature of this invention is the provision of means to impart motion to the stitching apparatus in three planes relative to the laminates being joined. The stitching device is small and light-weight, and capable of use with robotic systems as well as conventional gantry systems, thus enabling a variety of large contoured assemblies to be joined by stitching in an uncured state.

In addition to the feature of multiple axis movement, the invention is further characterized by the simplicity and ease of its operation and the ability to use multiple needle configurations when more than one row of stitches is required to adequately join laminates. In accordance with the present invention a vertically reciprocating needle shaft is mounted on a platform along with means for imparting reciprocating motion to the needle shaft. An oscilating thread feeding and positioning means is mounted on a frame that surrounds the needle, needle holder and needle support.

Another feature of the present invention is the ability of the stitching device to operate with multiple needles attached to the reciprocating needle shaft. This provides the capability of increasing machine output without increasing machine operating speed above that which is acceptable for consistent, reliable operation. In accordance with one embodiment of the present invention, from about four to about one self-threading needles are positioned in the needle holder and multiple strands of thread are placed in the thread positioner which is pivotally connected to the guide plate by a link which is also pivotally connected to the thread carrier which oscillates in a path perpendicular to the reciprocating path of the needles. Direction of thread carrier travel and link off set are controlled by the length of the link and by the degree of travel of the pneumatic cylinder operated needle shaft.

One very important feature of the present invention is its ability to function with respect to parts in assembly fixtures where all laminates to be joined can be put together and held in position by jigs while the composites are joined by stitching.

One advantage of the present invention is that this apparatus can be used when the laminates being joined are in such a position that only one side of the joint is accessible to the machine.

Another important advantage of the present invention is the ability of the device to be moved about the laminates which are uncured because the need to move parts being joined is eliminated. This also eliminates the need to heat the laminate in the area being stitched because the uncured laminate will allow passage of a needle without heating.

In accordance with these and other objects, features and advantages of the present invention, there is provided a self-threading stitching device for joining uncured preimpregnated composite laminates comprising a machine platform, a vertically reciprocating shaft mounted on the platform, means for imparting reciprocating motion to the shaft, thread feeding means operating synchronously with the shaft, means for synchronizing the movement of the thread feeding means with the movement of the shaft and self-threading needle-means adapted to pick up thread on its down-stroke, penetrate the composite laminates being joined and deposit the thread in said laminates in the form of a blind loop on the side of said laminate opposite the side of needle entry as said needle begins its upward stroke.

In accordance with the present invention the means for imparting recopricating motion to the shaft comprises a double action pneumatic cylinder so that both the down-stroke and the up-stroke of the shaft are made under power and a means for controlling the cyclic operation of the cylinder.

In accordance with the present invention the needle means comprises a needle holder which attaches the needle to the reciprocating shaft by means of a guide plate which engages the end of the reciprocating shaft and is interposed between the double action pneumatic cylinder and the composite laminates being joined. The needle holder and needle support attach to the guide plate by means of a dove-tail arrangement whereby the holder and support can be easily be removed from the guide plate for needle changes. The needle which is curved on one end passes through the central bore of the needled holder and support with the curved portion of the needle resting in an orienting groove in the top of the needle holder. The curve of the needle and the orienting groove are so arranged that the needle will fit in only one way thereby providing for the correct positioning of the needle eye. One surface of the guide plate adjacent to the needle holder is channelled to accept interchangeable bearing surfaces for contacting the thread feeding and positioning means.

Also in accordance with the present invention the thread feeding means comprises a thread supply, a first tensioning means mounted on the platform, carriage means affixed to said platform for mounting and supporting a second tensioning means which is located between the first tensioning means and the needle and a thread positioner which is slidably mounted on said carriage means so that when activated it can oscillate back and forth across the path of needle travel and in a plane parallel to the guide plate. A roller bearing attached to the end of a biased lever arm moves back-and-forth along the bearing surface so that the lever arm pivots about a point where it attaches to the carriage so that thread held by the opposite end of the lever arm oscillates into and out of the patch of needle travel and is properly positioned for pick up by the needle as it moves up and down through the composite laminates being joined.

Also in accordance with the present invention the needle comprises an open-eye needle adapted to catch and hold the thread on the downward stroke of the needle with the eye of the needle being adapted to hold the thread in the needle until the needle begins its upward stroke out of the laminate at which time the needle drops the thread to form a loop stitch.

Additionally, in accordance with the present invention the carriage position may be varied up and down in relation to the needle so that a constant stroke length can be achieved regardless of the length of the needle or thickness of the laminate.

Also in accordance with the present invention, the means for imparting reciprocating motion to the needle shaft comprises a double action pneumatic cylinder which powers both the downward and upward stroke of the needle thereby eliminating needle drag.

Additionally, in accordance with the present invention the device includes means for imparting three-dimensional movement of the platform and the stitching device mounted thereon in relation to the laminates being joined.

The present invention also includes means for synchronizing the rate of forward movement of the stitching device with the rate of reciprocating motion of the needle so that stitches of constant size are produced and the likelihood of thread or needle drag or hang up is minimized.

Also in accordance with the present invention the self-threading stitching device comprises a thread feeding and positioning means which is adapted for horizontal motion across the path of needle shaft movement, multiple self-threading needles adapted to engage thread provided by the thread feeding and positioning means as the needles move through their downward laminate penetrating stroke and support means for holding the multiple needles in a functional relationship with the reciprocating needle shaft.

Also in accordance with the present invention the thread feeding means comprises a thread supply, a first tensioning means mounted on the machine platform; support means mounted on the platform and surrounding a multiple needle head; a second thread tensioner affixed to the support means so that when threads are passed from the first tensioner to the multiple needles must first contact and function with the second thread tensioner. The thread positioner is pivotally attached to the guide plate and is adapted to receive multiple threads and guide them in an oscillating fashion across the path of the needles so that the threads are properly positioned for pick up by the needles as the needles make their downward laminate penetrating stroke.

Additionally, the present invention comprises means for ultrasonically vibrating the needles during each stitch cycle so that the needle can easily penetrate the laminates being joined with a minimum of damage to the laminate matrix and the reinforcement therein.

In accordance with the present invention there has been provided a means for moving the stitching device in three planes so that the needle is capable of following the contours of laminates being joined while the laminates are held in a fixed position.

In accordance with the present invention the method of joining uncured composite laminates by using blind stitches comprises providing uncured composite laminates laid up in a tool for imparting a desired shape to the laminate; providing a suitable thread for stitching the laminates being joined to a self threading needle means capable of moving in at least three planes so that the needle means can follow the contours of the laminates being joined as it moves across the surface thereof and stitching the laminates together while they remain in an uncured state and without moving the laminates.

These and other objects, features and advantages of the present invention will become more readily apparent with a reading of the following more particular description of a preferred embodiment in conjunction with the accompanying drawings. The drawings in which like reference characters indicate corresponding parts in all views, are not necessarily to scale, emphasis instead being placed on illustrating the principles of the invention.

BEST MODE OF CARRYING OUT THE INVENTION

Figure 1:
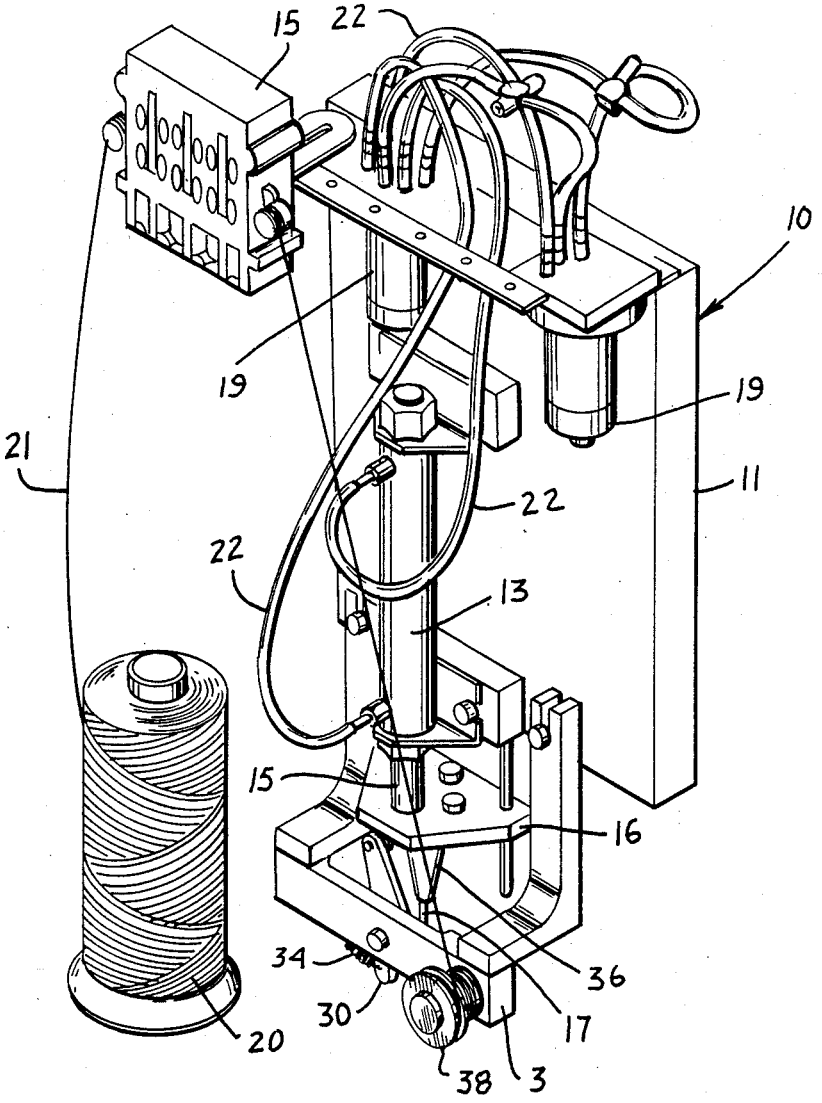
FIG. 1 is a pictorial representation of the self-threading stitching device of the present invention.
Figure 1A:
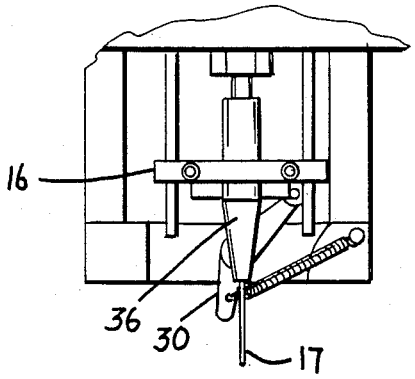
FIG. 1A is a detail representation of the sewing head portion of the present invention.
Figure 2:
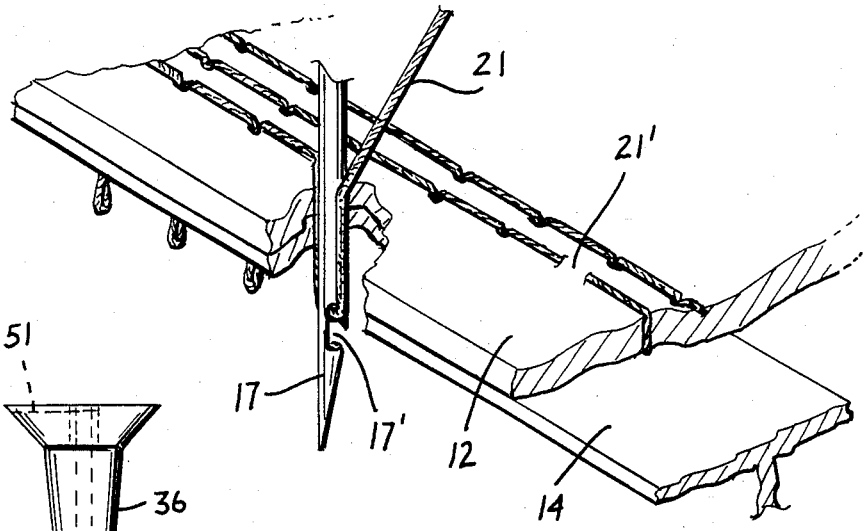
FIG. 2 is a pictorial representation of the interaction between needle, thread and the laminates being joined by the self-threading stitching device of the present invention.

Referring to FIG. 1, the apparatus of the present invention, generally indicated by the numeral 10, illustrates the stitching portion of the device separate from any movement control apparatus which might be used in combination with the portions of the apparatus which have only stitching functions. In its simplest form, the stitching device 10 comprises platform 11 upon which is mounted a double-action pneumatic cylinder 13. This cylinder 13 is connected to needle shaft 15 so that shaft 15 reciprocates, thereby causing the needle (not shown) and guide plate 16 to move up and down in relation to the laminates being joined. Air flows into cylinder 13 from control elements 19 through air lines 22. Thread 21 unwinds from spool 20 through tensioning cassette 18, thread tensioner 20, and through positioner (not visible in this view) to needle which forms stitches as it moves into, out of, and along the laminates being joined. FIG. 2 shows in more detail the functional relationship between needle 17 and thread 21 and laminates 12 and 14 as they interact to form stitches. The eye 17 of needle 17 is open and adapted to engage and carry thread 21 through uncured laminates 12 and 14. Uncured composite laminates of the type represented by 12 and 14 have a generally tacky and gum-like form thereby causing the laminates to adhere to thread 21 as needle 17 is retracted from the laminates to form loops 24 of stitches 21 upon curing of the laminates the loops are held fast in the composite matrix forming a strong joint between the two parts being joined. The vertical motion of needle 17 is provided by double-acting pneumatic cylinder 13 which, because both up and down strokes are powered, provides almost instantaneous insertion and extraction of needle 17 for smooth, fast and consistent stitching.

The stitching device 10 is readily adaptable to existing automated positioning systems. Weight and size of the device have been minimized so that robotic systems as well as conventional gantry systems may be used as positioners. In one embodiment of the present invention laminates being joined are placed on a horizontal bed on which they are properly positioned and held stationary because until the laminates have been cured they lack sufficient rigidity to support themselves. When the uncured laminates being joined are properly positioned in the horizontal tool bed, a three-axis gantry system propels and guides the stitcher 10 across the surface of the laminates so that stitches may be properly positioned to form the strongest possible joint between them.

Two key elements which enable the device to produce the desired blind stitch are: (1) needle configuration and (2) thread position. Proper needle configuration is illustrated by needle 17 which has an open-eye 17′ so that the thread 21 is engaged as the needle begins to penetrate the laminates at the joint and is released as the needle reaches the deepest point of its penetration of the laminates and begins the extraction cycle. Because needle 17 has an open eye 17′ and because the uncured laminates are gum-like, the needle 17 releases the thread 21 as it begins its upward motion, thread 21 is prevented from following the needle by the gum-like laminates which close in upon the thread 21 as the needle 17 is withdrawn thus creating the desired loop 24. Because needle 17 leaves loop 24 in the laminates 12 and 14 at the end of each stitch cycle the needle 17 and thread 21 must be reunited at the beginning of each stitch cycle.

Figure 3:
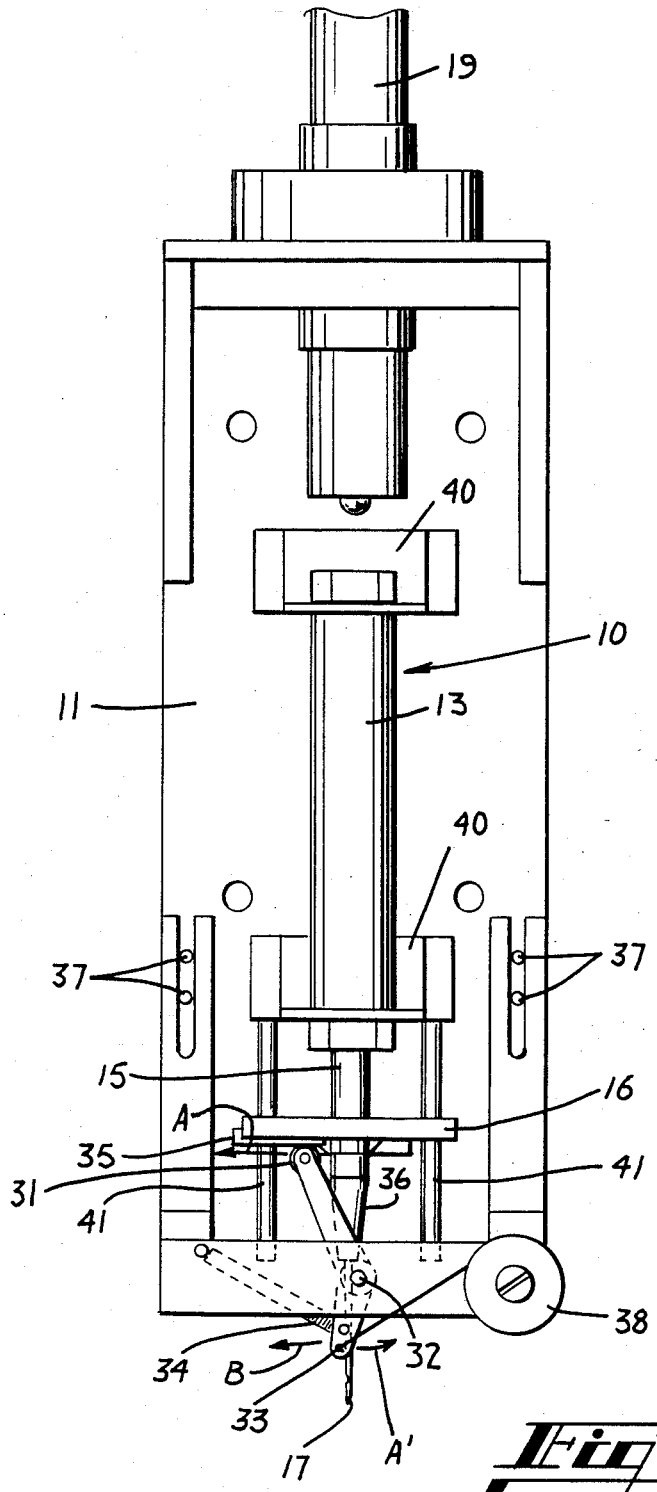
FIG. 3 is an assembly drawing of the self-threading stitching device of the present invention.
Figure 3A:
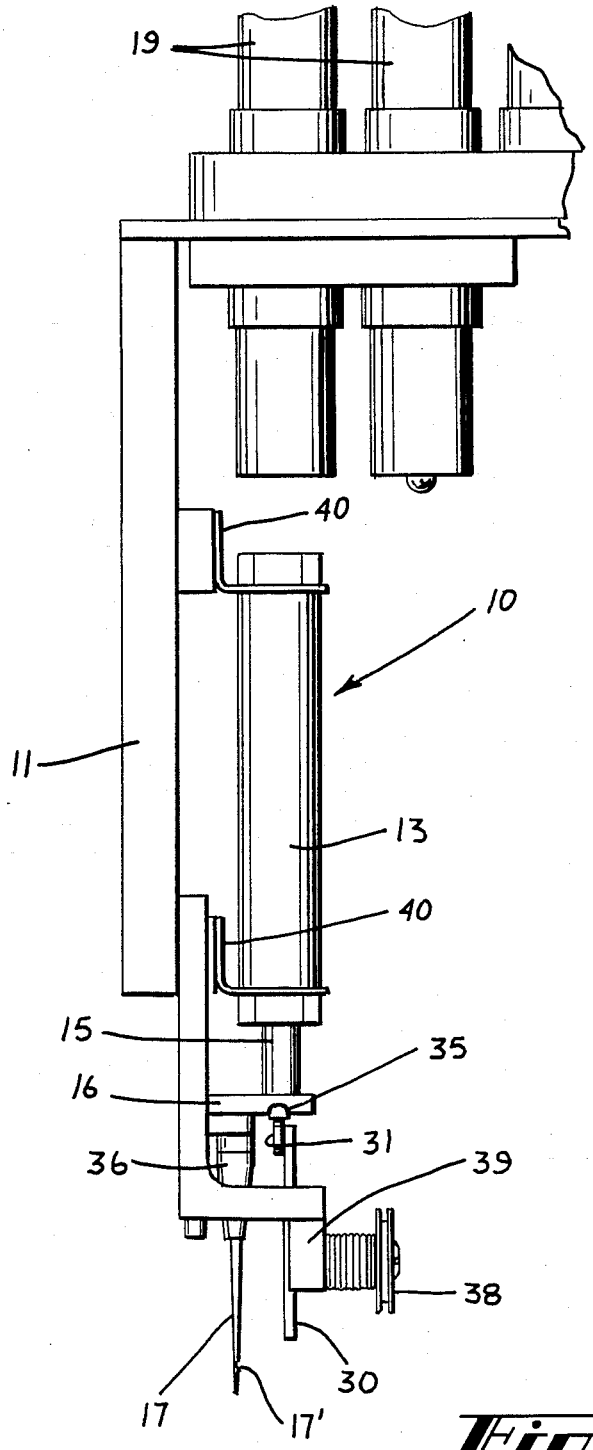
FIG. 3A is an assembly drawing of the apparatus of the present invention depicting the stitcher when viewed from the side.

To reunite needle 17 and thread 21 during each stitch cycle requires synchronizing the vertical movement of the needle with thread position. When viewed from the perspective of FIG. 3/3A the thread 21 must be positioned left of needle 17 when needle 17 is in the full-up position and thread positioner 30 will be positioned as shown in FIG. 3A. To reunite thread 21 and needle 17 as needle 17 begins its downward stroke, needle positioner roller 31 moves in the direction indicated by arrow A and thread positioner 30 pivots about axis 32 causing positioner 30 and thread guide 33 to swing in the direction indicated by arrow A' thus moving thread 21 right and across the path of needle 17 so that eye 17' engages thread 21 as needle 17 moves toward the laminates and carries it through the laminates before reaching the full-down position and beginning the extraction stroke. As needle 17 moves upward spring 34 which was extended on the downward stroke of the needle pulls thread positioner 30 in the direction indicated by arrow B causing thread 21 to assume its proper left of needle position and roller 31 to return to its correct full-up position. To facilitate easy movement of roller 31 across guide plate 16 bearing surface 35 has been machined into guide plate 16. The length of the arc through which thread guide 33 rotates and the distance along bearing surface 35 that roller 31 travels is determined by the stroke length of pneumatic cylinder 16 and can be adjusted to correspond thereto by the proper adjustment of the thread support bar 39 which is adjustably attached to platform 11 by means of adjusting bolts. Thread tensioner 37 mounts on support bar 39 and is provided to assure that the proper amount of slack is left in thread 21. If the appropriate amount of slack is not left in thread 21, stitches 21' will not be properly formed and will not have a consistent length and spacing. Cylinder mounting backets 40 are also provided to securely attach pneumatic cylinder to platform 11. A needle support 36 attaches to the underside of guide plate 16 so that needle 17 may be changed quickly and to protect needle 17 against breakage.

Figure 4A:
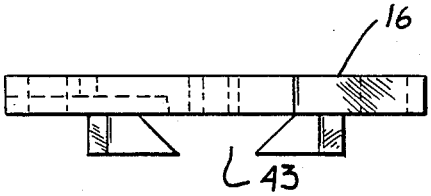
FIG. 4A is a side elevational view of the guide plate component rotated ninety degrees from the view shown in the drawing of FIG. 4.
Figure 4:
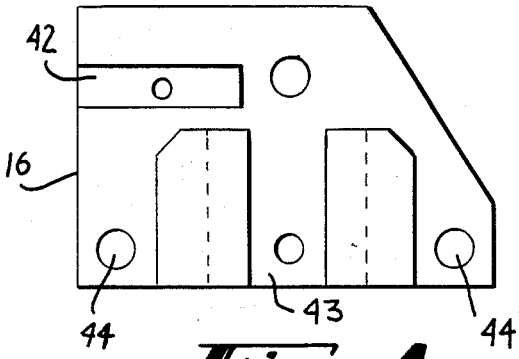
FIG. 4 is a detail drawing of the guide plate component of the present invention.

FIGS. 4 and 4A provide more detail with regard to guide plate 16 which attaches to one end of shaft 15 so that the dove-tail 43 is oriented downward. Additional lateral stability is provided for guide plate 16 and needle 17 by rods 41 which are attahced to support arm 36 on one end and cylinder bracket 40 on the other and project through bores 44 and in guide plate 16. When the stitches are in operation guide plate 16 moves up and down on rods 41 which extend through bores 44.

Figure 5:
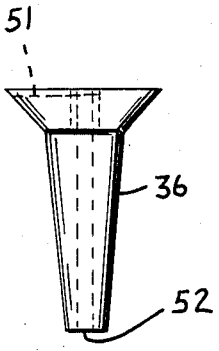
FIG. 5 is a detail drawing of the needle holder and needle support of the present invention.
Figure 5A:
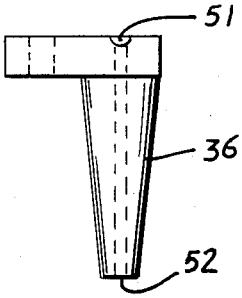
FIG. 5A is a side elevational view of the needle holder rotated ninety degrees from the view shown in FIG. 5.
Figure 5B:
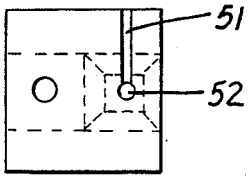
FIG. 5B is a top view of the needle holder.

Bearing surface 35 is removably mounted in slot 42 so that in the event a longer or shorter needle or a longer or shorter cylinder stroke requires a change in thread positioner angle this change can be accommated by providing a longer or shorter bearing surface. The bearing surface 35 used comprises a hardened dowel of appropriate diameter with a machined flat to provide for easy motion of the thread positioner without subjecting guide plate 16 to excessive wear. Needle support 36, FIGS. 5, 5A and 5B, is adapted to slide into dove-tail 43 to promote, easy needle changes. Groove 51 is provided to accept a curved portion of needle 17 in only one way so that eye 17' is always correctly oriented with respect to thread 21 when the point of needle extends from bore 52.

Figure 7:
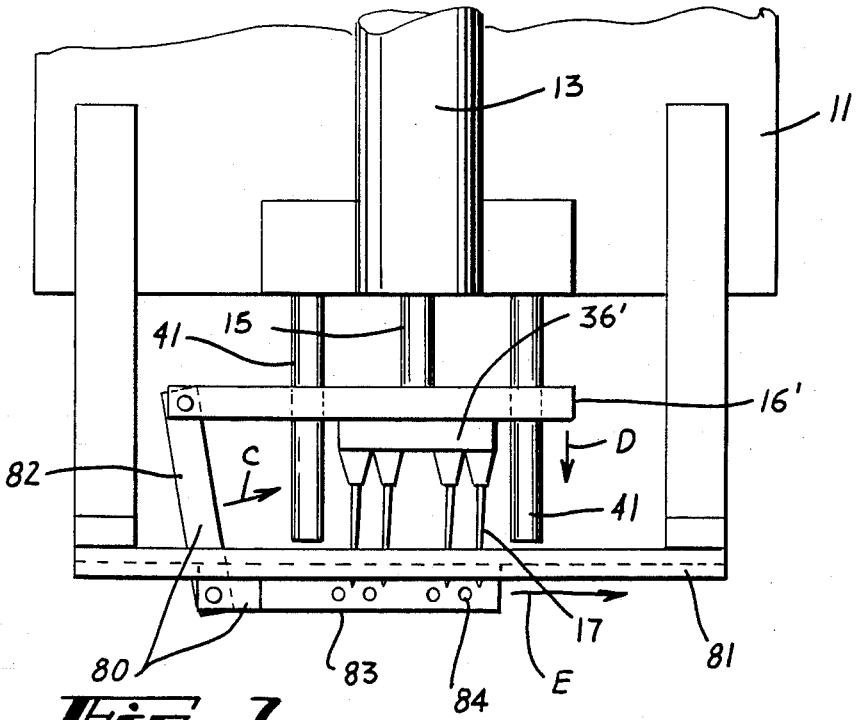
FIG. 7 is a front view of the multiple needle embodiment of the present invention.
Figure 8:
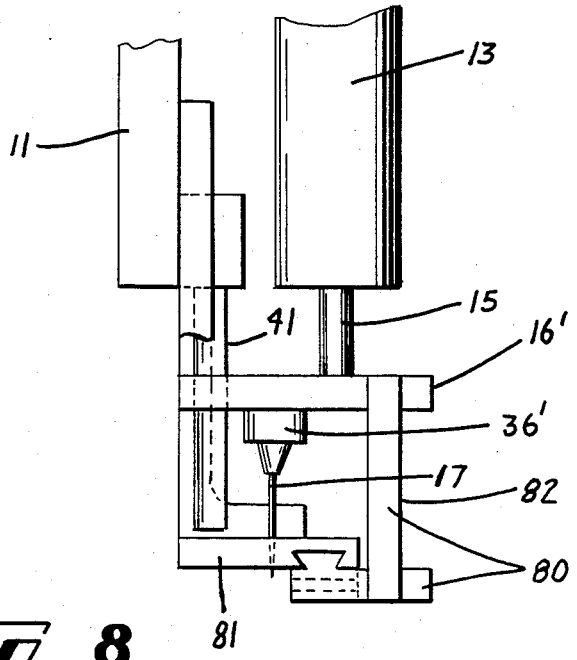
FIG. 8 is a side view of the multiple needle embodiment of the present invention rotated ninety degrees from the view in FIG. 7.

Another embodiment, FIG. 7 and FIG. 8, of the self-threading stitches previously described involves the use of multiple needles. When multiple needles are used the main problem is to position several threads for engagement by different needles simultaneously so that several lines of stitches can be sewn into a joint at one time. When operating, multiple needle support 36' controls stitch line spacing and provides for single pass stitching of composite laminate joints. Multiple thread positioner 80 accomodates up to four threads and provides for self-synchronizing movement with multiple needle support 36'. Positioner 80 is a slide-crank combination with the slide 83 serving as the thread handler and the crank 82 providing reciprocating motion. The crank 82 is the vertical member of thread positioner 80 and is pivotally connected with guided plate 16' and pivots from this connection in the direction indicated by arrow C as guide plate 16' moves in the direction indicated by arrow D. As crank 82 pivots in direction C, slide 83 which carries the thread to needles 17 through bores 84 moves in the direction indicated by arrow E. When guide plate 16' moves upward in relation to the laminates being joined crank pivots in the opposite of direction C thereby causing slide 83 to reverse its original direction of movement along positioner support bracket 81 and consequently moving the threads out of the needle path.

Figure 6:
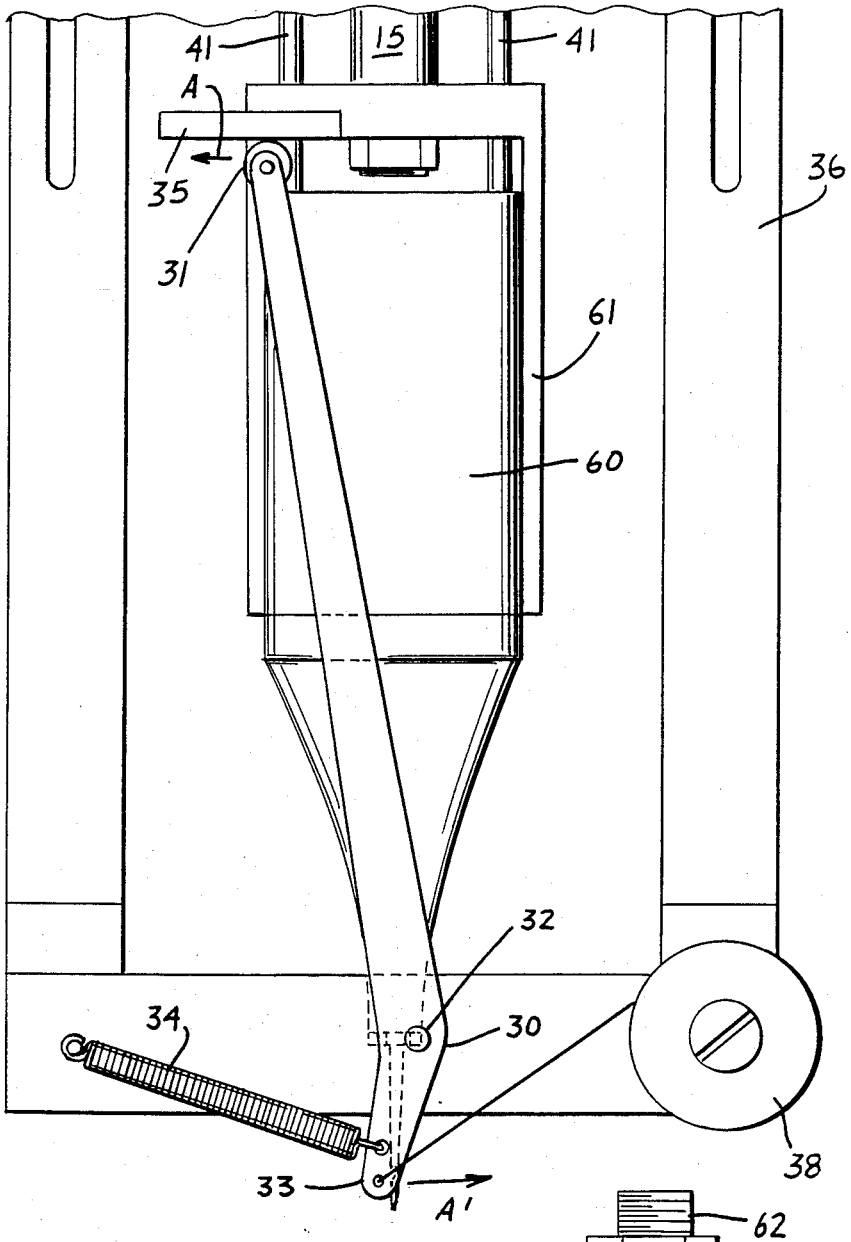
FIG. 6 shows the embodiment of the present invention which uses ultrasonic vibration to facilitate the penetration of the laminate of the needle.
Figure 6A:
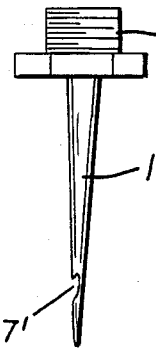
FIG. 6A is a detail drawing of the needle used with the ultrasonic embodiment of the present invention.

Referring now to FIGS. 6 and 6A which illustrate another embodiment of self-threading stitching apparatus 10 in which ultrasonic vibration of the needle is used to improve the penetrating efficiency of the device thereby reducing the damage to the matrix and to the reinforcement. In order to transmit ultrasonic energy to needle 17 so that vibrations of the proper frequency can be started in the needle of the guide plate of the previously discussed embodiments of stitches 10 is replaced by the horn mounting bracket 61 which is drilled to fit over guide rods 41 as did the guide plate. Horn mounting bracket 61 is also channeled to accept bearing surface 35 to facilitate motion by thread positioner 30. Ultrasonic horn 60 is mounted inside horn mounting bracket and transmits ultrasonic energy to needle 17 through titanium collet 62 so that operation of this embodiment is substantially the same as operation of previously described embodiments except that ultrasonic energy is used to vibrate needle 17 to facilitate its penetration of the laminates being joined.

As it has been described herein before the self-threading stitching device can be used with any reinforced preimpregnated epoxy or polyimide or equivalent matrix composite. Such composites could be reinforced with unidirectional mat or woven reinforcing fibers and the fiber so used could be selected from the group of fiber glass, aramid fiber, graphite, boron or mixtures thereof with the only caveat being that needle sizes and stitching rates must be chosen to reduce damage to the reinforcing fibers contained in the composite matrix. Additionally, nylon, aramid, and fiberglass base threads are acceptable for use in forming the stitches which reinforce the laminate joints.

Although the present invention has been discussed and described with primary emphasis on two embodiments, it should be obvious that adaptations and modifications can be made without departing from the spirit and scope of the invention.

What is claimed is:

1. A self-threading stitching device for joining uncured composite laminates comprising a machine platform, a vertically reciprocating needle shaft mounted on said platform, means for imparting reciprocating motion to said needle shaft, a thread feeding means operating synchronously with the needle shaft, means for synchronizing the movement of said thread feeding means with the movement of said shaft and self-threading needle means adapted to pick up thread on its downstroke and to carry said thread through said uncured composite laminate as said needle means penetrates said laminate, said needle means being further adapted to release said thread in said laminate as the needle shaft begins its upward stroke so that a thread loop is left protruding from that side of the composite laminate which is the opposite side from needle entry.

2. The self-threading stitching device of claim 1 wherein said means for imparting reciprocating motion comprises a double-action pneumatic cylinder and means for controlling the cyclic operation of said pneumatic cylinder.

3. The self-threading stitching device of claim 1 wherein said needle means comprises a needle holder adapted to receive and hold a needle in a fixed relationship with respect to said reciprocating needle shaft, said needle holder further including a planar guide plate, one surface of which faces said laminate and which surface has machined therein a bearing surface for contacting said thread feeding means.

4. The self-threading stitching device of claim 1 wherein said thread feeding mechanism comprises a thread supply, a first thread tensioning means mounted on said platform, support means mounted on said platform and surrounding said needle, a second thread tensioner means mounted on said support means whereby thread when passed from said first tensioner means to said needle must first contact said second thread tensioner means and thread positioner means pivotally mounted on said support means and adapted to receive and guide said thread into position for pickup by said needle as the needle moves downward and into said laminate.

5. The self-threading stitching device of claim 4 wherein said thread positioner means comprises a biased lever arm pivotally attached to said support means at a point, with a roller bearing affixed to one end thereof, said roller bearing being in contact with a bearing surface on said needle holder and the other end having thread guide means for receiving said thread and guiding it to said needle and being attached to said support means by biasing means which is attached on one end to said lever arm and on the other to said support means whereby when said needle moves up and down in relation to said laminate, said roller bearing moves along said bearing surface in oscillating motion substantially perpendicular to the direction of needle movement.

6. The self-threading stitching device of claim 3 wherein said needle means further comprises an open-eye needle adapted to catch and hold said thread on the downward stroke of said needle shaft, wherein said needle holds said thread as the laminate is penetrated by said needle and releases said thread to form a loop on the upward stroke of said reciprocating needle shaft.

7. The self-threading stitching device of claim 5 wherein said support means further includes means to adjust the positioning of said support means in relation to said needle.

8. The self-threading stitching device of claim 7 wherein said support means further includes means for positioning said needle in proper functional relationship with said thread positioner means whereby no adjustment of needle eye orientation is required to make the device operational after a needle change.

9. The self-threading stitching device of claim 1 wherein said means for imparting reciprocating motion to said needle shaft comprises means for applying a time positive downward thrust to said needle shaft on each downward penetration stroke and means for applying positive upward power to said needle shaft on each upward retraction stroke whereby said reciprocating needle shaft cycles from penetration stroke to extraction stroke in a consistent manner the frequency of which cycles can be predetermined and controlled by the operator.

10. The self-threading stitching device of claim 1 further including means for moving said device in relation to a work piece and means for synchronizing said motion to the rate of stitching so that there is no needle hangup and stitch size and spacing remain constant for a given stitching rate.

11. A self-threading stitching device for joining uncured composite laminates comprising a machine platform, a vertically reciprocating needle shaft mounted on said platform, means for imparting reciprocating motion to said needle shaft, thread feeding and positioning means adapted for horizontal motion across the path of movement of the shaft in synchronous relationship with said needle shaft, means for imparting horizontal and synchronous motion to said thread feeding and positioning means, multiple self-threading needle means adapted to pick up thread from said thread feeding and positioning means as said self-threading needle means moves through its downward stroke and being further adapted to carry said thread through said uncured composite laminate and support means for holding said multiple self-threading needle means in a functional relationship with said needle shaft.

12. The self-threading stitching device of claim 11 wherein said means for imparting reciprocating motion comprises a double-action pneumatic cylinder and means for controlling the cyclic operation of said cylinder.

13. The self-threading stitching device of claim 11 wherein said needle support means comprises a needle holder adapted for easy removal and further adapted to receive more than one needle in a fixed relationship with respect to said reciprocating needle shaft and said thread feeding and positioning means.

14. The self-threading stitching device of claim 11 wherein said thread feeding means comprises a thread supply, a first thread tensioning means mounted on said platform; support means mounted on said platform and surrounding said needles; a second thread tensioner means mounted on said support means whereby thread when passed from said first tensioner means to said needles must first contact said second thread tension means and thread positioner means pivotally attached to said guide plate and adapted to receive and guide thread substantially perpendicularly across the path of said needles whereby said thread is properly positioned for pickup by the eyes of said needles as said needles progress through the downward penetration stroke of a stitch cycle.

15. The self-threading stitching device of claim 14 wherein said thread positioner means is further adapted to swing out of the path of motion of said needles as said needles and said needle shaft pass through the extraction portion of the stitch cycle.

16. The self-threading stitching device of claim 13 wherein said needle holder adapted for easy removal comprises a needle support grooved to receive a curved portion of a needle shaft and hold the same in a fixed position and a guide plate, said guide plate being dovetailed to receive and hold said needle support whereby the eye of said needle is locked into a predetermined position with respect to said thread positioner.

17. The self-threading stitching device of claim 11 further comprising means for ultrasonically vibrating said needles during a stitch cycle whereby penetration of the uncured laminate is facilitated and damage to the laminate matrix and the reinforcement therein is minimized.

18. The self-threading stitching device of claim 11 further comprising means for imparting motion to said stitching device along the X,Y and Z axes thereof whereby said needle means is capable of following the natural contours of an uncured laminate being joined to another uncured laminate while said laminates are held in a fixed position.

19. A method of joining uncured composite laminates by stitching said laminates together from only one side of said laminates comprising the steps of:

(a) providing uncured graphite epoxy work pieces;
(b) securing said uncured work pieces to a means for holding said laminates together;
(c) providing a self-threading stitching apparatus and a means for moving said stitching apparatus along the surface of said work pieces;
(d) moving said stitching apparatus along a joint connecting said work pieces and joining the same by loop stitches implanted along said joint.

* * * * *